US011702313B2

(12) United States Patent
Cuff

(10) Patent No.: US 11,702,313 B2
(45) Date of Patent: Jul. 18, 2023

(54) MULT THREADER WITH SEPARATOR SHAFT ASSEMBLY AND CLAMP BAR

(71) Applicant: Butech, Inc., Salem, OH (US)

(72) Inventor: Jason Cuff, Columbiana, OH (US)

(73) Assignee: BUTECH, INC., Salem, OH (US)

( * ) Notice: Subject to any disclaimer, the term of this patent is extended or adjusted under 35 U.S.C. 154(b) by 119 days.

(21) Appl. No.: 17/162,831

(22) Filed: Jan. 29, 2021

(65) Prior Publication Data

US 2021/0238004 A1 Aug. 5, 2021

Related U.S. Application Data

(60) Provisional application No. 62/972,362, filed on Feb. 10, 2020, provisional application No. 62/968,349, filed on Jan. 31, 2020.

(51) Int. Cl.

| | |
|---|---|
| ***B65H 57/16*** | (2006.01) |
| ***B65H 57/04*** | (2006.01) |
| ***B21C 47/00*** | (2006.01) |
| ***B21C 47/32*** | (2006.01) |
| ***B21C 47/34*** | (2006.01) |

(52) U.S. Cl.

CPC ..... *B65H 57/16* (2013.01); *B21C 47/006* (2013.01); *B21C 47/323* (2013.01); *B21C 47/3433* (2013.01); *B65H 57/04* (2013.01)

(58) Field of Classification Search

CPC .. B65H 57/04; B65H 57/16; B65H 2701/173; B65H 2701/37; B65H 2301/4148; B65H 65/00; B21C 47/006; B21C 47/323; B21C 47/3433

See application file for complete search history.

(56) References Cited

U.S. PATENT DOCUMENTS

| | | | | |
|---|---|---|---|---|
| 3,863,858 A * | 2/1975 | Cauffiel | B65H 23/10 | 242/530.1 |
| 3,999,665 A * | 12/1976 | Rogers | B21C 47/006 | 414/800 |
| 4,270,684 A * | 6/1981 | Cauffiel | B21C 47/006 | 226/162 |
| 6,964,392 B1 * | 11/2005 | Matsunaga | B65H 23/188 | 242/530.1 |

* cited by examiner

*Primary Examiner* — William E Dondero
(74) *Attorney, Agent, or Firm* — Lippes Mathias LLP

(57) ABSTRACT

A mult threader assembly has a mult threader frame, a movable carriage that is slidably disposed on the frame, a fixed clamping member, a separator shaft mounted on the movable carriage, and a movable clamping member mounted on the movable carriage.

22 Claims, 9 Drawing Sheets

MULT THREADER WITH SEPARATOR SHAFT ASSEMBLY AND CLAMP BAR

CLAIM OF PRIORITY

This application claims priority from Provisional Application Ser. No. 62/968,349 filed on Jan. 31, 2020 and 62/972,362 filed on Feb. 10, 2020, the entireties of which are hereby incorporated by reference herein.

BACKGROUND OF THE DISCLOSURE

The present disclosure relates to mult threaders. It finds particular application in conjunction with a mult threader with a separator shaft assembly and clamp bar, and will be described with particular reference thereto. However, it is to be appreciated that the present disclosure is also amenable to other like applications.

In the metals Industry, both ferrous and non-ferrous, rolling mills are used to roll the process metal down into a strip form which is subsequently wound into a coiled shape. Some of these wound coils of metal strip are forwarded to slitting lines where the coiled strip is unwound, partially flattened, and then passed through a slitting machine.

The slitting machine cuts the width of the strip into individual strands known in the industry as "mults". The balance of this description will refer to the individual strands of strip as "mults".

At the slitting machine, a whole width of a coil can be slit into many mults; for example, as little as two mults or as many as thirty or more mults. The more mults, the more difficult it is for the machinery downstream of the slitter to be threaded and ultimately rewind the mults into side by side narrow coils on the recoiler.

A difficulty associated with threading the mults is that the leading edges of the mults are not all lined up in a straight pattern. The layout of the knives in the slitting machine tends to apply either a slight upturn or a slight downturn to the leading edge of a given mult. For example, a given mult may have a slight upturn to the leading edge, while the adjacent mult may have a slight downturn to the leading edge.

Further during the threading process, downstream of the slitter, there is a need to develop a gap between adjacent side by side mults. This is done to keep the mults from crossing over or overlapping each other as they are threaded through the remainder of the process line. Should the crossing over or overlapping occur, the slitting process line would have to be stopped and the crossed tangled mults would need to be sorted out.

To keep the mults properly aligned and separated from each other, the individual mults are threaded between separator discs that are mounted on a separator shaft. There may be several separator shaft/disc assemblies stationed progressively downstream of the slitting machine.

As the leading edges of the mults approach the recoiler mandrel, the leading edges need to be directed down into the recoiler's gripper slot. Once the mults are in the gripper slot, the gripper is closed, and the recoiler mandrel starts winding the coil.

Since adjacent leading edges of the mults are alternately bent up or down, it is difficult to insert the leading edges into the gripper slot on the recoiler mandrel. Many times, dependent on strip thickness, an operator needs to manipulate the leading edges of the mults to get them into the gripper slot.

While the mults are being wound on the recoiler mandrel, there is again a need for separator discs to be placed between adjacent (i.e., side by side) mults to keep them from crossing over (i.e., overlapping) each other during the winding process. When the operator manipulates the leading edges of the mults, he has to also make sure the position and spacing of the mults will result in the mults falling between recoiler's separator discs.

A problem with operator involvement in the threading of the recoiler is it reduces the productivity of the slitting line and may cause potential safety issues for the operator. Moreover, the more slit mults the operator has to handle; the more time is lost to the threading process.

Thus, there is a need to improve the threading process at the recoiler and reduce operator involvement. Specifically, a mult threader with a separator assembly and clamp bar is provided to overcome the above mentioned deficiencies and others while providing better overall results.

SUMMARY OF THE DISCLOSURE

In accordance with a preferred embodiment of the disclosure, a mult threader assembly has a mult threader frame, a movable carriage that is slidably disposed on the frame, a fixed clamping member, a separator shaft mounted on the movable carriage, and a movable clamping member mounted on the movable carriage.

In accordance with another embodiment of the disclosure, a method of threading mults includes providing a mult threader frame, slidably disposing a movable carriage on the frame, providing a fixed clamp member, mounting a separator shaft on the movable carriage, and mounting a movable clamping member on the movable carriage.

In accordance with another aspect of the disclosure, a mult threader has a fixed clamp bar and a moveable mating clamp bar. A separator shaft and the moveable clamp bar are mounted on a moveable carriage, that is slidably disposed and guided on a mult threader frame. The moveable clamp bar is preferably operated by cylinders. When the cylinders are retracted, the clamp bar is in a wide-open position.

In accordance with another aspect of the disclosure, a mult threader frame is attached to a fixed frame through a pivot point. A cylinder is attached to the mult threader frame at pivot points. When the cylinder is retracted, the mult threader is in a near vertical position which represents the mult threader's line run position which also serves as the mult threader position for threading the line.

In accordance with another aspect of the disclosure, the mult threader is preferentially positioned just after a deflector roll and just before a recoiler mandrel.

In accordance with another aspect of the disclosure, the leading end of the mults progresses to and passes slightly through the mult threader. Cylinders are operated to extend which in turn advances the moveable carriage towards the fixed clamp bar. The individual mults fall between the separator discs, i.e., one mult in each gap between adjacent separator discs. On occasion, operator assistance may be needed to guide the mults, which makes it easier when the mults are flat than when they are contained in the recoiler mandrel gripper slot.

In accordance with another aspect of the disclosure, cylinders advance the moveable carriage until the mults are clamped between the fixed clamp bar and the moveable mating clamp bar. The separator shaft assembly is mounted on the moveable carriage. This allows the mults to stay between the separator discs, while the clamping action takes place.

In accordance with another aspect of the disclosure, once the leading end of the mults is in a gripper slot, the gripper is closed resulting in clamping of the mults. The recoiler mandrel is rotated to start winding of the mults. Simultaneously, the mult threader frame is partially retracted away from the mandrel and, simultaneously, the recoiler separator shaft assembly is operated to lower towards the recoiler mandrel.

In accordance with another aspect of the disclosure, when the recoiler separator shaft assembly is on the surface of the wound mults, the mult threader frame is further retracted away from the recoiler mandrel, and the mult threader moveable carriage is fully opened. This places the mult frame in a near vertical position, and the mult threader separator discs are disengaged from the mults and positioned well below the passline of the mults while the line is running.

In other situations, the separator shaft assembly may be at least partially raised during a run, especially if a large number of mults are in the line.

In accordance with another aspect of the disclosure, the mult threader clamp bars are mounted in a way that makes it easy to maintain the clamp bar pads, and easy to adjust the clamped position of the mults relative to the separator discs.

In accordance with still another aspect of the disclosure, the mult threader is not limited to usage in a slitting line that utilizes a notching machine. For other configuration slitting lines there may be more separator shaft assemblies than in the line discussed above, but the function and placement of the mult threader remains the same.

Still other aspect of the disclosure will become apparent upon a reading and understanding of the following detailed disclosure.

DETAILED DESCRIPTION OF THE DISCLOSURE

Referring to FIGS. 1-9, a mult threader in accordance with a preferred embodiment of the disclosure will be described and shown.

Figure 3:
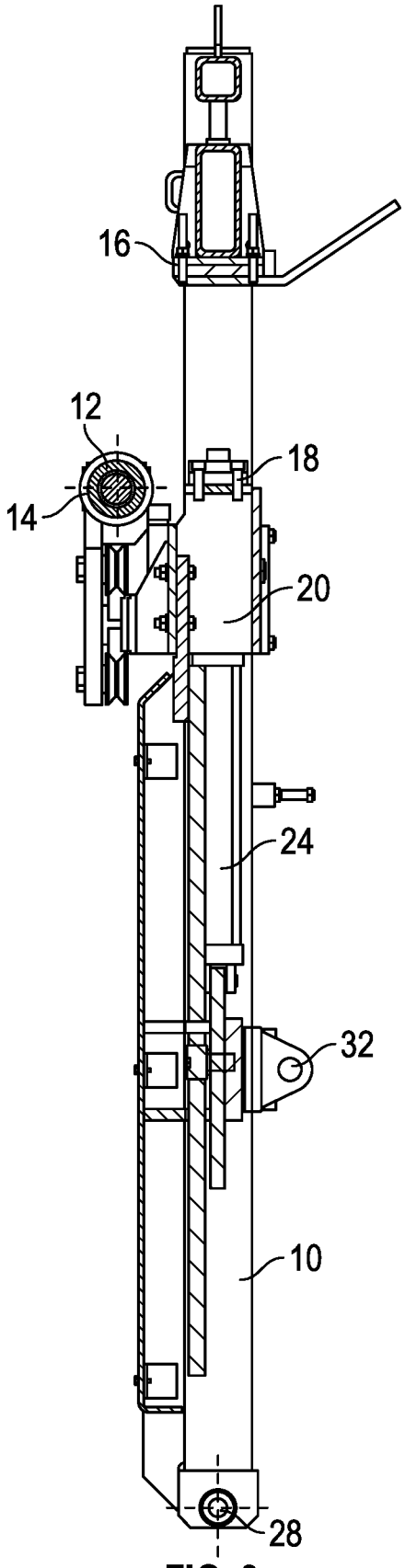
FIG. 3 is a side elevational view of the mult threader in accordance with a preferred embodiment of the disclosure.
Figure 4:
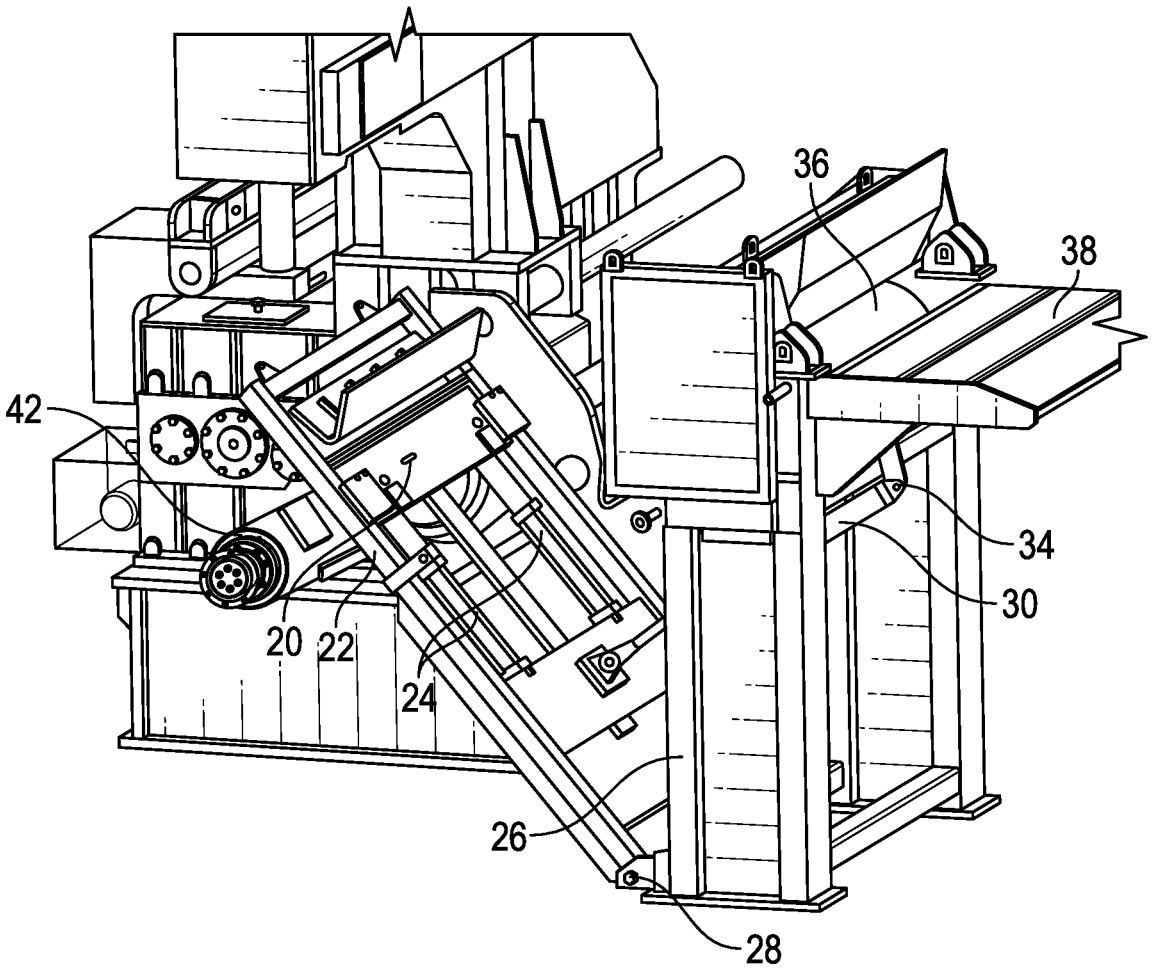
FIG. 4 is a perspective view of the exit end of the slitting line, with the mult threader of FIG. 3 shown in the deployed position.

Referring to FIGS. 3 and 4, a mult threader 10 includes a separator shaft 12 on which separator discs 14 are mounted. The gap between adjacent separator discs 14 is equivalent to the width of a mult 15 (see, e.g., FIG. 6) that will be threaded between that pair of separator discs 14. It is not necessary for all the mults to be of the same width. Consequently, the spacing between adjacent separator discs 14 can vary or be the same, across the width of the separator shaft 12.

Mult threader 10 has a fixed clamp bar 16 and a moveable mating clamp bar 18. Both separator shaft 12 and moveable clamp bar 18 are mounted on a moveable carriage 20 that is slidably disposed and guided on mult threader frame 22 (see FIG. 4). Moveable clamp bar 18 is operated by hydraulic cylinders 24. When cylinders 24 are retracted, clamp bar 18 is in a wide-open position.

Mult threader frame 22 is attached to a fixed frame 26 (see FIG. 4) through a pivot point 28. Hydraulic cylinder 30 is attached to mult threader frame 22 at pivot point 32 and at pivot point 34 (FIGS. 3 and 4). When cylinder 30 is retracted, mult threader 10 is in a near vertical position which represents the mult threader's line run position which also serves as the mult threader 10 position for threading the line.

Fixed frame 26 may or may not have other equipment such as a deflector roll 36, a threading table 38 or any other line equipment.

Figure 2:
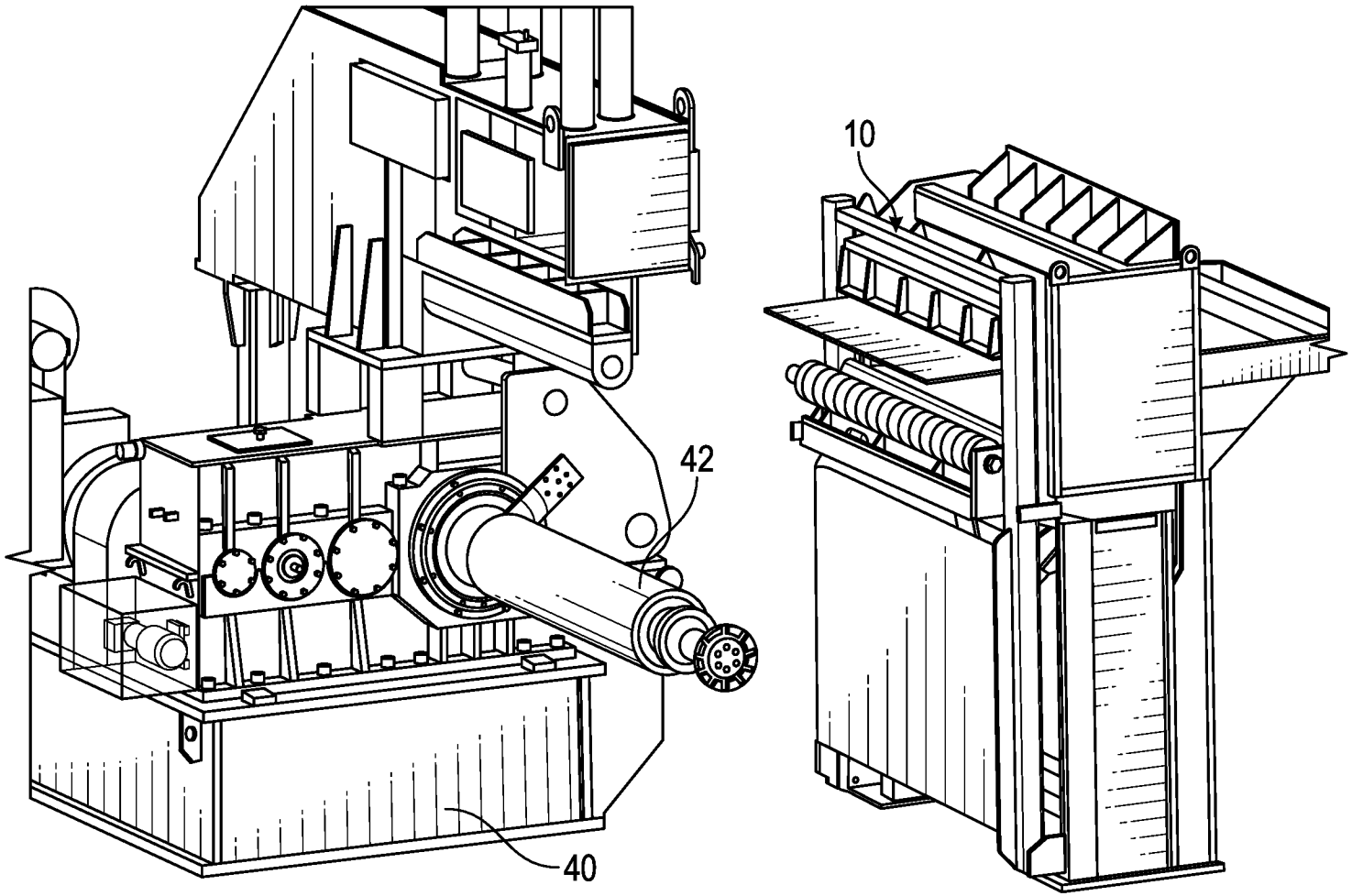
FIG. 2 is a perspective view of the exit end of the slitting line with the mult threader shown in the line run position.
Figure 5:
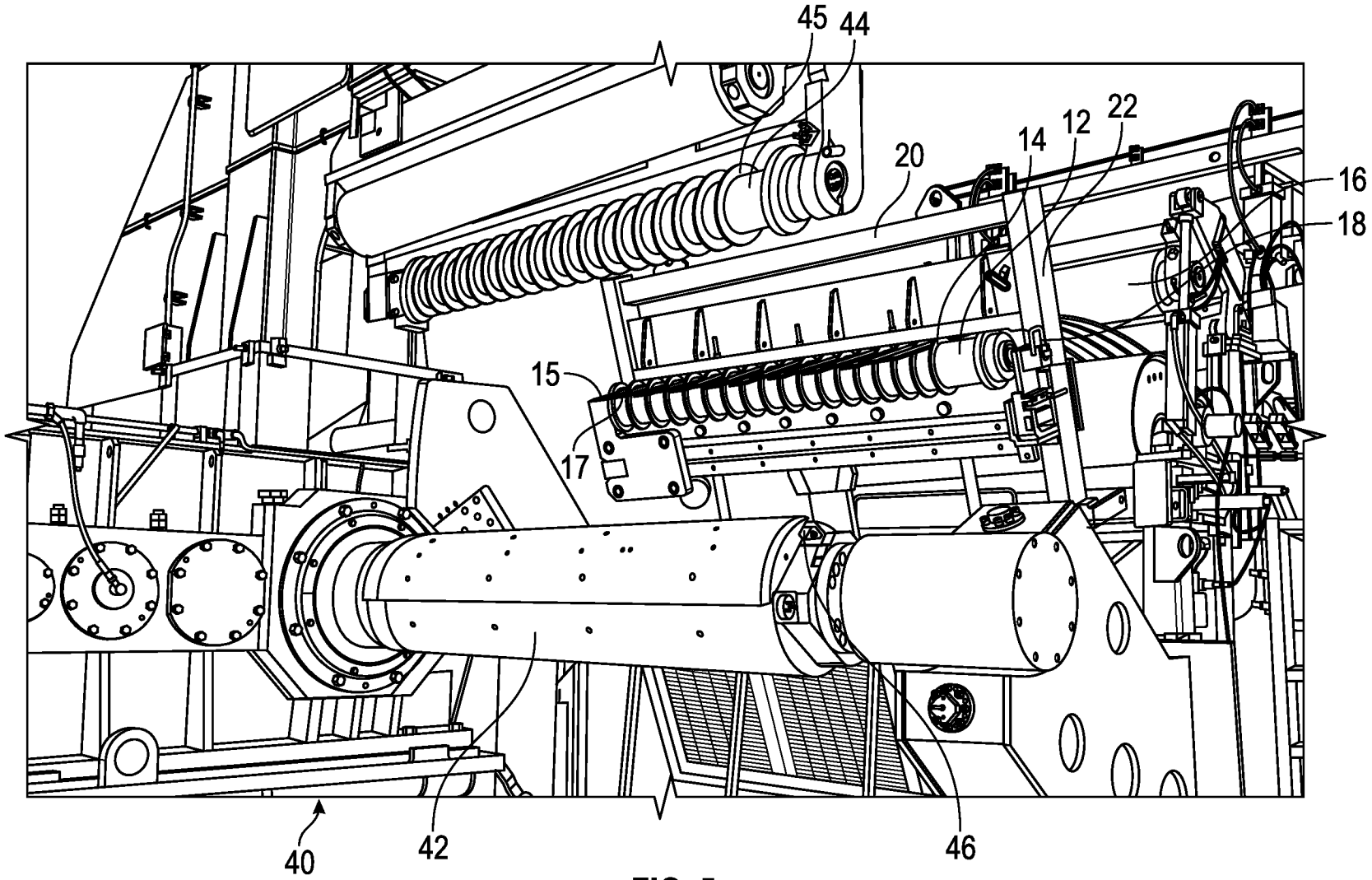
FIG. 5 is a perspective view of the mult threader and the recoiler in accordance with a preferred embodiment of the disclosure.

Referring now to FIG. 2 and FIG. 5, recoiler 40 includes a recoiler mandrel 42, a recoiler overarm separator shaft 44, as well as other equipment that can be used with this disclosure. As shown in FIG. 5, the recoiler mandrel has a mult receiving gripping slot 46. Recoiler mandrel gripping slot 46 is in an open position when the mults 15 are threaded to the recoiler mandrel 42. Recoiler overarm separator shaft 44 is in its fully raised position when the mults 15 are threaded to the recoiler mandrel gripping slot 46.

Figure 1:
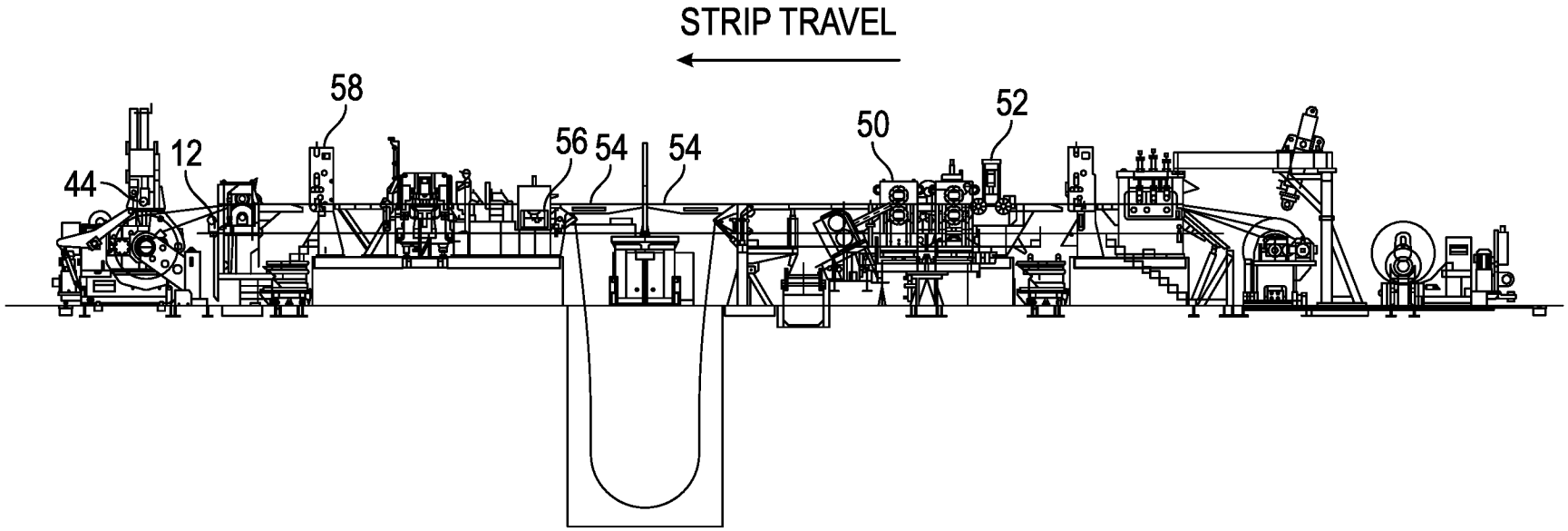
FIG. 1 is a side elevational view of a typical existing slitting line with a direction arrow identifying the direction of the strip being processed.

For an existing slitting line depicted in FIG. 1, ahead of slitter 50, there is a notching machine 52. After a looping pit, there is a separator shaft assembly 56, and an exit crop shear 58. Notching machine 52 is used to keep the leading edge of the strip from being cut into mults; typically, this is approximately the first twelve (12) inches of the leading end of the strip. The notching shear 52 is not a prerequisite for the mult threader.

The mult threader is preferentially positioned just after deflector roll 36 and just before recoiler mandrel 42. Prior to threading the slitting line, the slitting knives are positioned and spaced on slitter 50 arbors.

Separator shaft assemblies 56, 12 and 44 have separator discs 14, 45 that are spaced, and located on their shafts, such that the spacing and location of the separator discs is relative to the spacing and location of the slitting/cutting planes set-up at the slitter 50.

After the strip is slit, the leading edge is conveyed on tables 54 across the looping pit.

The leading end of the strip progresses to crop shear 58, and the unslit leading edge is cut off by crop shear 58.

The leading end of the mults progresses to and passes slightly through mult threader 10. Cylinders 24 are operated to extend which advances moveable carriage 20 towards fixed clamp bar 16 (see, e.g., FIG. 5). The individual mults 15 fall between adjacent separator discs 14; one mult 15 in each gap between adjacent separator discs 14. On occasion, the mults are guided by the operator to fall between separator discs 14. A pivotable platform may be added which allows the operator to stand on the platform to guide the mults as they move over the discs and fall. Moveable carriage 20 is momentarily stopped for this action to take place.

Cylinders 24 then advance moveable carriage 20 until the mults are clamped between fixed clamp bar 16 and moveable mating clamp bar 18. Separator shaft assembly 12 is mounted on moveable carriage 20. This allows the mults to stay between the separator discs 14, while the clamping action takes place.

Figure 6:
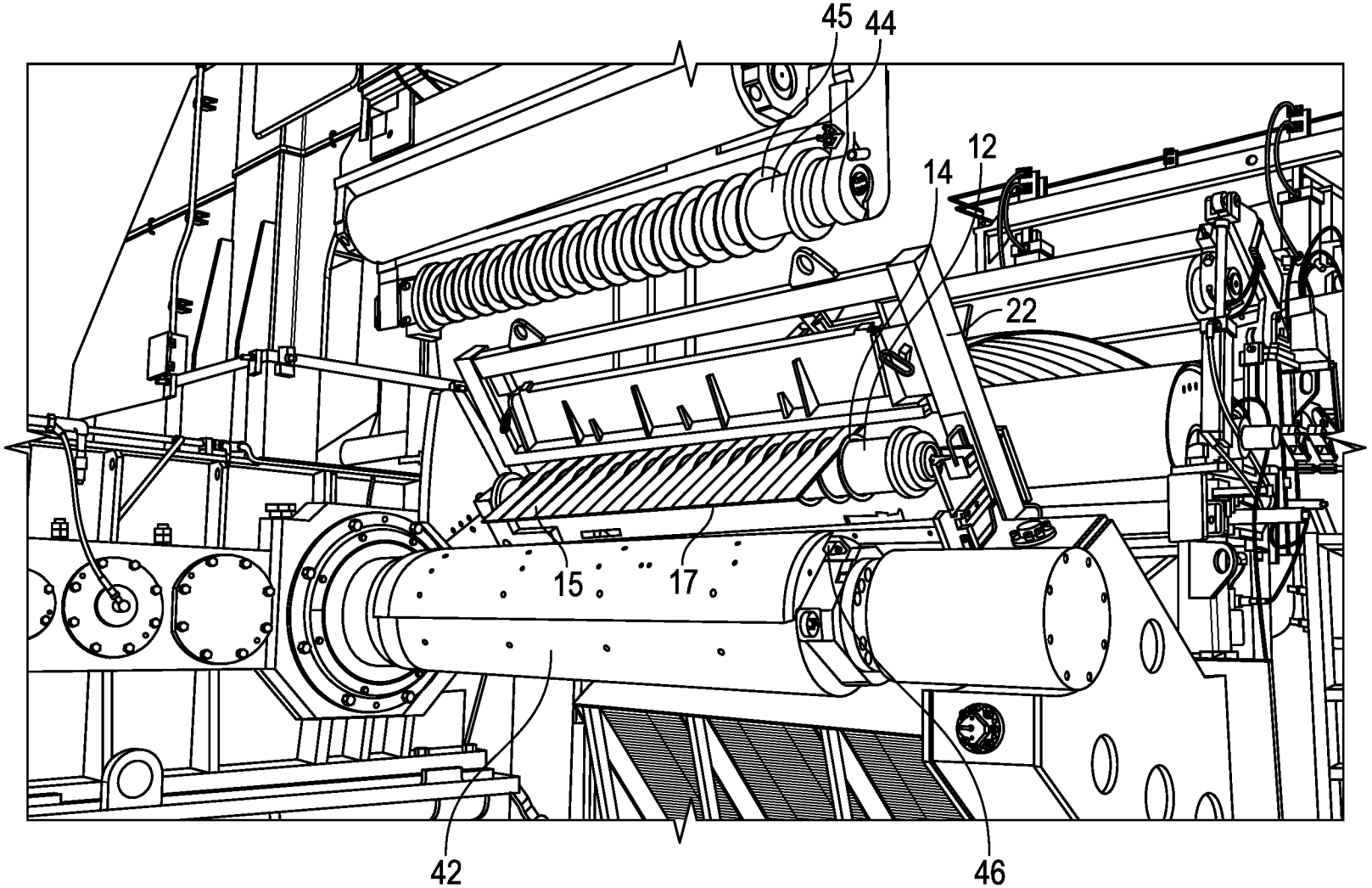
FIG. 6 is a perspective view of the mult threader and recoiler with the movable carriage pivoting towards said recoiler.

Referring to FIG. 6, recoiler mandrel 42 is rotated until the recoiler mandrel gripping slot 46 is positioned to receive a leading end 17 of the mults 15. Cylinder 34 is operated to extend which results in the mult threader frame 22 pivoting towards recoiler mandrel gripping slot 46. This action continues until the leading ends of the mults are received in recoiler gripping slot 46. This may require some interaction between the position of the recoiler mandrel 42 and the position of the mult threader frame 22.

Figure 7:
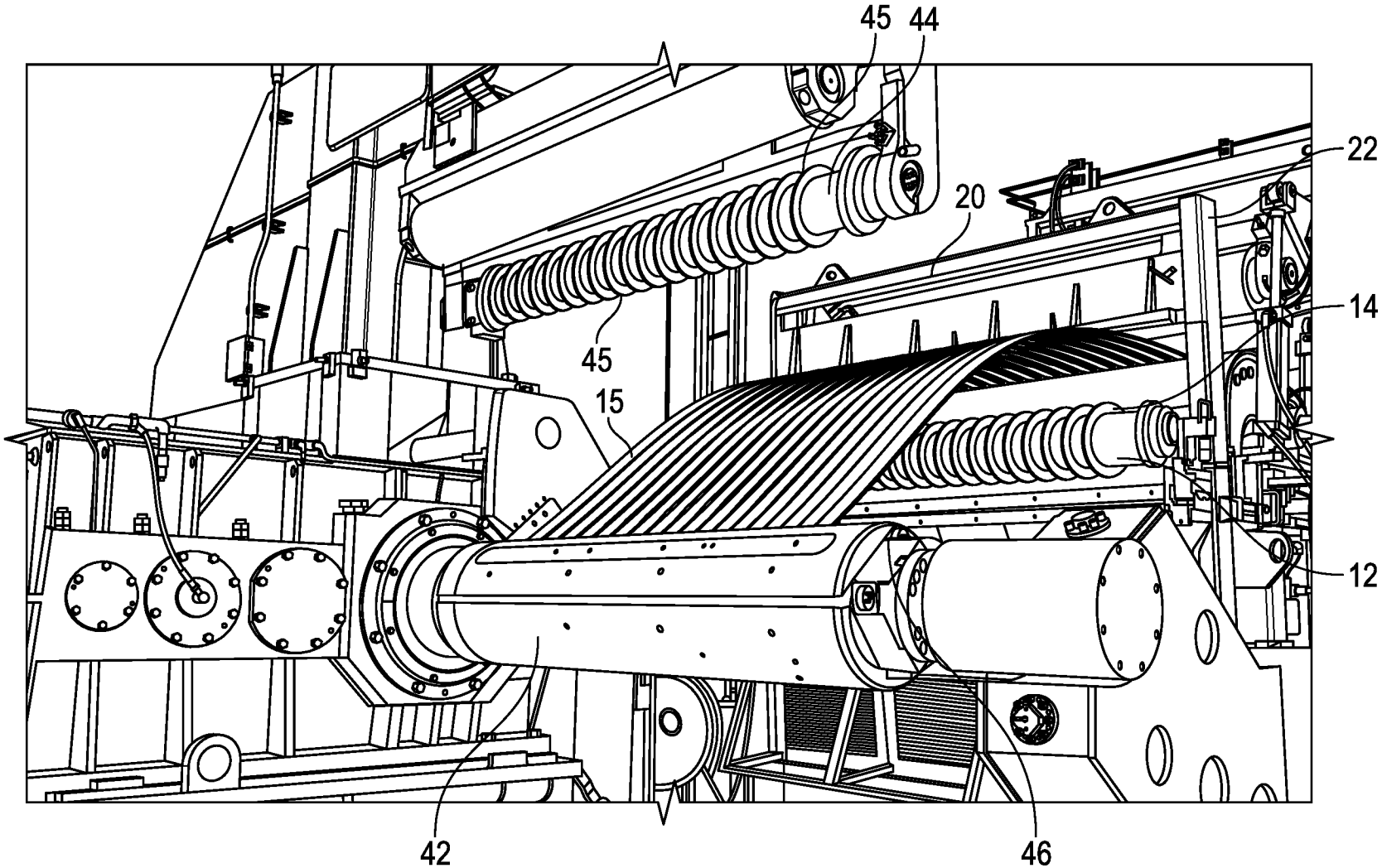
FIG. 7 is a perspective view of the mult threader with the mults engaged with the recoiler gripping slot.
Figure 8:
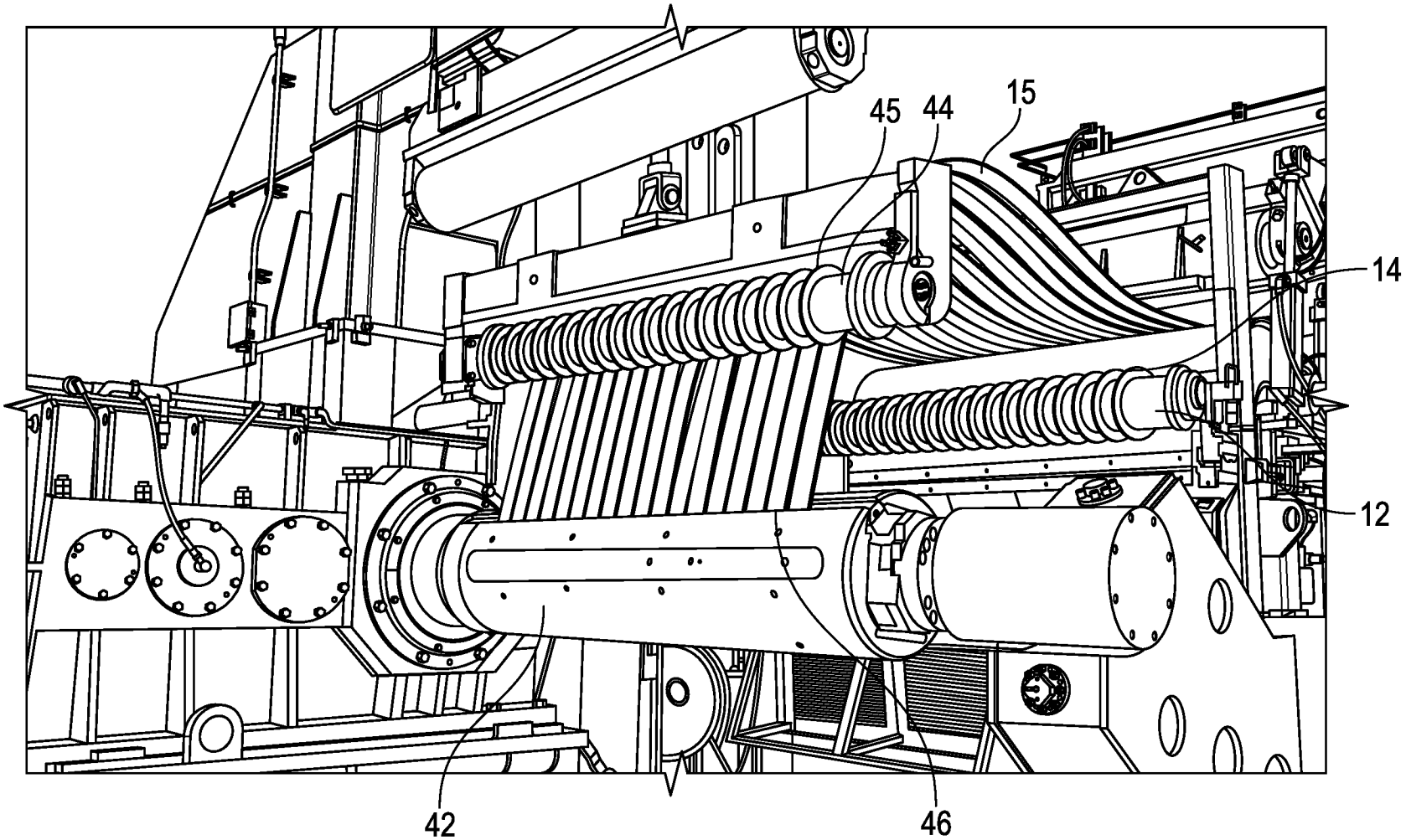
FIG. 8 is a perspective view of the recoiler overarm separator shaft engaging the mults; and, FIG. 9 is a perspective view of the recoiler overarm separator shaft separating the mults.
Figure 9:
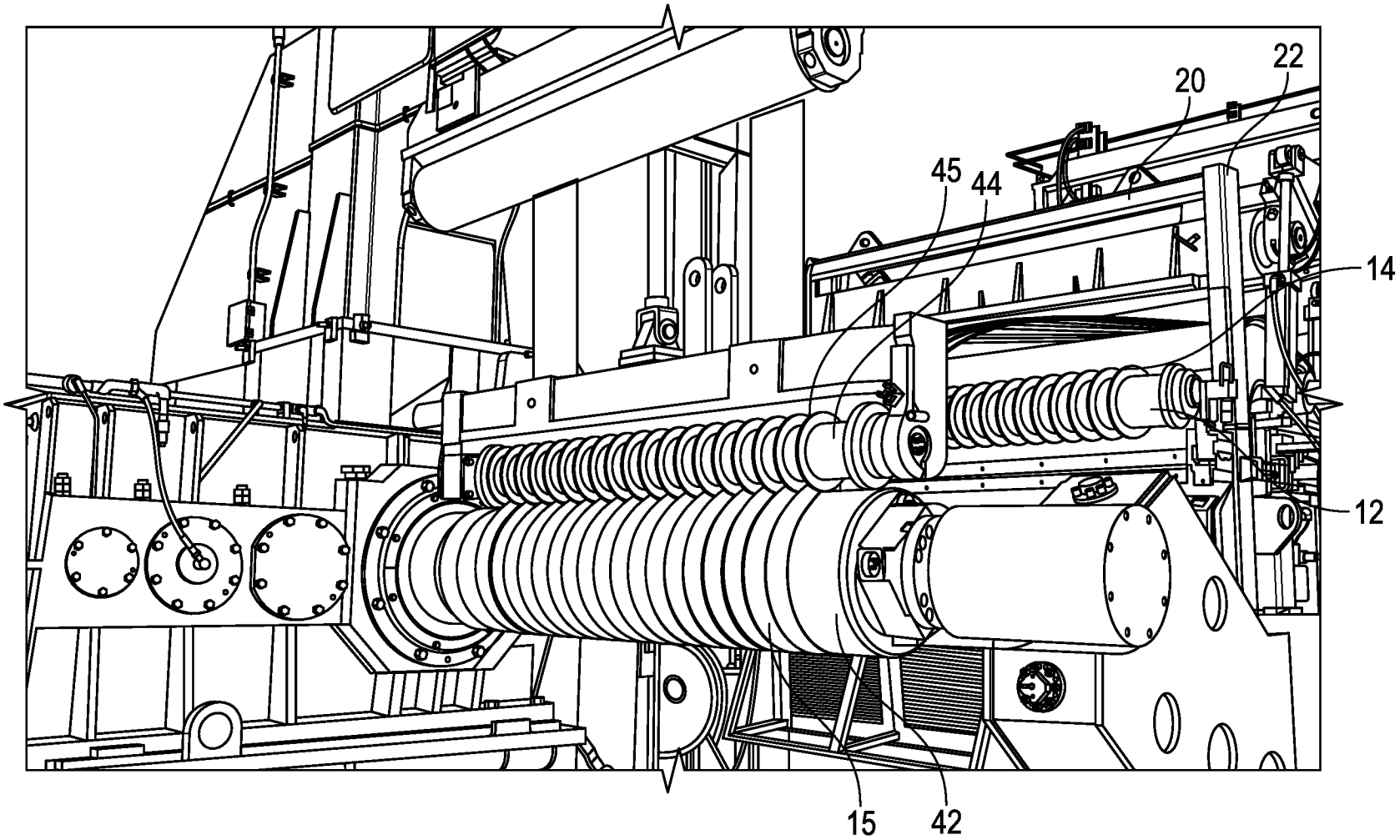

Referring to FIG. 7, once the leading end of the mults is in the mandrel gripping slot 46, the mandrel gripper is closed resulting in clamping of the mults 15. At this point, the mult threader is partially opened by cylinder 24. That is, carriage 20 is partially lowered by cylinder 24 (see, e.g., FIGS. 3 and 4). The recoiler mandrel 42 is rotated to start winding of the mults. Simultaneously mult threader frame 22 is partially retracted away from mandrel 42, and simultaneously recoiler overarm separator shaft 44 is commanded to lower towards the recoiler mandrel 42. These actions are interactive and positionally commanded by the operator such that by the time the recoiler overarm separator shaft 44 is engaged on the surface of the wound mults (see FIGS. 8 and 9), mult threader frame 22 is positioned to loop the mults upwards, thus allowing the mults to align with the separator discs 45 on the recoiler overarm separator shaft 44.

When recoiler overarm separator shaft 44 is on the surface of the wound mults 15, mult threader frame 22 is further retracted away from recoiler mandrel 42 (see FIG. 9), and mult threader moveable carriage 20 is fully opened. This places mult frame 22 in a near vertical position, and mult threader separator discs 14 are disengaged from the mults and positioned well below the passline of the mults while the line is running.

The slitting line is now ready to run and process the strip.

Mult threader separator shaft assembly 12 is mounted in a way that makes it easy to remove the separator shaft and retool for a different slitting/cut schedule for the slitting line.

Mult threader clamp bars 16, and 18 are mounted in a way that makes it easy to maintain the clamp bar pads, and easy to adjust the clamped position of the mults relative to the separator discs 14.

Mult threader 10 is not limited to usage in a slitting line that utilizes the notching machine. For other configuration slitting lines there may be more separator shaft assemblies than in the example line, but the function and placement of the mult threader remains the same.

There can be various degrees of automation associated with the sequence described above. Some slitting lines can be configured to be essential self-threading with little or no intervention by the operator. Other slitting lines can be configured for the operator to have full control over some or all the steps in the sequence. The level of automation is a user preference and does not change the essence of the design.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims and disclosure or the equivalents thereof.

The invention claimed is:

1. A mult threader assembly comprising:
a mult threader frame;
a movable carriage that is slidably disposed on said frame;
a fixed clamping member;
a separator shaft mounted on said movable carriage;
said separator shaft comprises one or more separator discs mounted on said separator shaft;
a movable clamping member mounted on said movable carriage;
wherein a gap is formed between adjacent separator discs to accommodate a width of said mult threaded between said adjacent separator discs; and
wherein said mult threader frame is attached to a fixed frame via a pivot point.

2. The mult threader assembly of claim 1, further comprising a hydraulic cylinder mounted at said pivot point to move said mult threader frame relative to said fixed frame.

3. The mult threader assembly of claim 2, wherein a leading edge of said mutt passes over said separator discs of said separator shaft.

4. The mult threader assembly of claim 3, wherein said leading edge of said mult passes through said mult threader assembly.

5. The mult threader assembly of claim 4, wherein said mult aligns with said separator discs.

6. The mult threader assembly of claim 5, wherein said movable carriage is moved by said hydraulic cylinder until said mult is clamped between said fixed clamping member and said movable clamping member.

7. The mult threader assembly of claim 6, wherein a recoiler mandrel is positioned until a gripping slot receives a leading edge of said mult.

8. The mult threader assembly of claim 7, wherein said mult threader frame is retracted from said recoiler mandrel and a recoiler separator shaft moves toward said recoiler mandrel to engage said mult.

9. The mult threader assembly of claim 8, wherein said recoiler separator shaft engages a surface of said mult wound on said recoiler mandrel.

10. The mult threader assembly of claim 8, wherein said mult threader frame is positioned to loop said mult in an upward direction thus allowing said mult to align with separator discs of said recoiler separator shaft.

11. The mult threader assembly of claim 1, further comprising a recoiler mandrel having a gripping slot for receiving mults threaded onto said recoiler mandrel.

12. The mutt threader assembly of claim 1, further comprising a slitter for slitting a strip of metal.

13. A method of threading mults, comprising:
providing a mult threader frame;
slidably disposing a movable carriage on said frame;
providing a fixed clamping member;
mounting a separator shaft having separator discs on said movable carriage;
forming a gap between adjacent separator discs to accommodate a width of a mult threaded between said adjacent separator discs;
mounting a movable clamping member on said movable carriage;
moving said movable clamping member via one or more hydraulic cylinders; and
attaching said mult threader frame to a fixed frame via a pivot point.

14. The method of claim 13, further including mounting a hydraulic cylinder at said pivot point to move said mult threader frame relative to said fixed frame.

15. The method of claim 14, further including providing a recoiler mandrel having a gripping slot for receiving said mult threaded to said recoiler mandrel.

16. The method of claim 15, further including passing a leading edge of said mutt over said separator discs of said separator shaft.

17. The method of claim 16, further including said mutt aligns with separator discs of said separator shaft.

18. The method of claim 16, further including moving said movable carriage by said hydraulic cylinder until said mult is clamped between said fixed clamping member and said movable clamping member.

19. The method of claim 18, further including positioning said recoiler mandrel until said gripping slot receives said leading end of said mult.

20. The method of claim 19, further including retracting said mult threader frame from said recoiler mandrel and a recoiler separator shaft moves toward said recoiler mandrel to engage said mult.

21. The method of claim 20, further including engaging said recoiler separating shaft with a surface of said mult wound on said recoiler mandrel.

22. The method of claim 21, further including positioning said mult threader frame to loop said mult in an upward direction thus allowing said mult to align with separator discs of said recoiler separator shaft.

* * * * *